United States Patent [19]

Boyce

[11] 4,032,909

[45] June 28, 1977

[54] ARRANGEMENT FOR TESTING AN ALARM SYSTEM AND METHOD

[75] Inventor: William N. Boyce, Gering, Nebr.

[73] Assignee: Eugene E. Karsten, Gering, Nebr. ; a part interest

[22] Filed: July 7, 1975

[21] Appl. No.: 593,651

[52] U.S. Cl. ..... 340/214; 340/416; 325/66

[51] Int. Cl.[2] ..... G08B 19/00

[58] Field of Search ..... 340/410, 214, 213 R, 340/408, 409, 411, 416, 224; 179/59; 325/66

[56] References Cited

UNITED STATES PATENTS

| | | | |
|---|---|---|---|
| 2,525,697 | 10/1950 | Lurig | 179/5 R |
| 3,149,317 | 9/1964 | Brugliera | 340/224 |
| 3,594,788 | 7/1971 | Seelig | 340/410 |

*Primary Examiner*—William M. Wannisky
*Attorney, Agent, or Firm*—Crandell & Polumbus

[57] ABSTRACT

An arrangement for testing an alarm system, requiring only a single individual. The alarm system itself includes an alarm activation circuit, a main alarm, for example an audio alarm, and a plurality of remote sensors all connected together such that activation of at least one of the remote sensors activates the alarm circuit which, in turn, activates the alarm. The testing arrangement senses whether the alarm activation circuit has been activated in response to the activation of one of the sensors. If it has, the testing arrangement automatically deactivates the alarm circuit and the alarm, preferably in an adjustably fixed period of time after activation of the circuit. Thereafter, preferably after a second adjustably fixed period of time, the arrangement automatically causes the alarm activation circuit to be reset. In addition, the testing arrangement preferably includes its own alarm preferably an audio alarm, which is activated during this second adjustably fixed period of time. At the end of this period the second alarm is automatically deactivated.

19 Claims, 3 Drawing Figures

ARRANGEMENT FOR TESTING AN ALARM SYSTEM AND METHOD

BACKGROUND OF THE INVENTION

The present invention relates generally to an alarm testing arrangement and more particularly to an arrangement which can readily and reliably be operated by a single individual and to a method of testing the alarm system, again by a single individual.

A typical alarm system will include a main alarm panel which houses the required circuitry for operating the system. This circuitry may be referred to as the alarm activation circuit. The system will also typically include one or more main alarms, for example an audio alarm and possibly a visual alarm located in the vicinity of the alarm panel, possibly directly in the panel. In addition, a plurality of remote sensors, for example heat sensors, smoke sensors or the like, would be located at various points in the area of surveillance. Where this area comprises a large building or even an entire complex, the sensors could and would be located great distances from one another and great distances from the main alarm panel.

In operation, if one of the remote sensors should activate, i.e., respond to heat, smoke or the like within its own area of surveillance, it automatically activates the main alarm activation circuit which, in turn, activates the main alarm or alarms. In other words, once the sensor is activated, it causes the alarm circuit to function in the manner required to activate the alarm or alarms. The main alarms at the main alarm panel will remain activated until it is manually deactivated or automatically deactivated by appropriate circuitry. In the typical alarm system, once the alarm circuit is activated and subsequently deactivated, it must be manually reset for further operation. This is generally provided for by a switch at the alarm panel.

In the past, testing of an alarm system of the type just described has generally required two individuals. One individual would station himself by the main alarm panel and the other individual would go out to the remote sensors and one by one activate the sensors. Each time the sensor is activated, the individual stationed at the panel would see whether activation of the sensor activates the alarm circuit and main alarm and if it does this information would be passed to his partner at the remote sensor and, at the same time, he would manually reset the alarm circuitry so that the next sensor in line could be tested. An audio transmitter/-receiver unit, for example a walkie talkie setup, could be used to provide communication between the two individuals.

An obvious drawback in the testing method just described is that it requires two people. Another drawback resides in the fact that each time a remote sensor is activated, activating the main alarm, particularly the main audio alarm, this alarm remains activated until the individual stationed at the panel deactivates it. Where a large number of sensors need to be tested, the repetitious sounding of the alarm or alarms could be and probably would be a large nuisance to the people working in the surrounding areas, particularly if the alarm system is in a hospital, school or office area.

As will be seen hereinafter, the present invention provides both an arrangement for and a method of testing an alarm system of the type described above without the drawbacks just discussed. This testing can be carried out by a single individual in a reliable and economical manner and in no more time than has been required heretofore. In addition, the testing can be carried out with minimal nuisance noise from the main alarm if any at all.

SUMMARY OF THE INVENTION

An object of the present invention is to provide an arrangement for testing an alarm system, which arrangement requires only one individual regardless of the fact that many if not most of the sensors comprising part of the system are located great distances from the main alarm circuitry.

Another object of the present invention is to provide a testing arrangement which is uncomplicated, relatively economical and which is reliable.

Still another object of the present invention is to provide a testing arrangement which as a result of the alarm testing produces minimal nuisance noise from the main alarms, if any at all.

Yet another object of the present invention is to provide an arrangement for testing an alarm system which automatically provides for the deactivation of the main alarm circuit and alarm, once activated and which automatically provides for the resetting of this circuit.

A further object of the present invention is to provide this last mentioned arrangement with means for adjustably fixing the period of time between activation of the main alarm circuit and alarm and its deactivation and means for adjustably fixing the period of time after which the alarm circuit is reset.

Still a further object of the present invention is to provide this last mentioned arrangement with its own alarm preferably an audio alarm, which activates after activation and subsequent deactivation of the alarm circuit whereby deactivation time of the main alarm can be minimized if not in fact practically eliminated, thereby minimizing if not practically eliminating the nuisance noise from the main alarm.

A further object of the present invention is to provide a method of testing an alarm system, which method includes the various features just discussed.

A typical alarm system to which the present invention is directed is one which includes a main alarm activation circuit, i.e., the various components and circuitry required for operating the system most if not all of these components are located in a main alarm panel at a central location within the total area covered by the alarm system. The alarm system also typically includes one or more main alarms including an audio alarm and possibly visual alarms located at or near the main alarm panel and a number of remote sensors, for example heat sensors, smoke sensors or the like.

The alarm activation circuit, main alarm or alarms and the remote sensors are connected together such that activation of at least one of the sensors automatically activates the alarm circuit which, in turn, automatically activates the main alarm or alarms. The alarm circuit once activated and subsequently deactivated must be reset. In many alarm systems, resetting of the alarm circuit is done manually by means of a switch at the alarm panel. Further, in many of these systems the alarm circuit is automatically reset after it has been disconnected from its power supply and subsequently reconnected therewith. As will be seen hereinafter, the present invention takes advantage of this particular typical feature.

In accordance with the present invention, an arrangement for testing an alarm system of the general type just described is disclosed herein. This arrangement includes first means for sensing whether the main alarm circuit has been activated in response to the activation of one of the sensors, second means for automatically deactivating the circuit in the event the circuit has been activated and third means for automatically causing the main alarm circuit to be reset after activation and subsequent deactivation thereof. In this manner, a single individual can go from one remote sensor to another activating each as he goes. After the first sensor is activated, the testing arrangement senses whether the alarm circuit has been activated and conveys this information to the tester. The arrangement automatically deactivates the alarm circuit and thereafter automatically resets it without requiring the tester to be at the main alarm panel, i.e., at the main alarm circuit.

In a preferred embodiment, this arrangement includes first circuit means responsive to the activation of the alarm circuit for producing a signal which is applied to the circuit for automatically deactivating it and hence for automatically deactivating the main alarm. This signal is preferably produced an adjustably fixed period of time after activation of the circuit. Where the arrangement includes its own alarm ultimately responsive to activation of the sensor, this period of time is preferably very short so that the main alarm is activated for only a short period of time.

The preferred arrangement also includes second circuit means connected with the first means and also with a second alarm, preferably an audio alarm, also comprising part of the arrangement. This second means activates the second alarm in response to the first signal, i.e., upon deactivation of the first or main alarm. Third means connected with the second means deactivates the second alarm in a second adjustably fixed period of time after its actuation and at the same time produces a second signal which is applied to the main alarm circuit for automatically resetting the circuit.

In a specific embodiment, the arrangement in accordance with the present invention includes a signal regulating circuit which is connected to the alarm circuit for producing an initiation signal in response to the activation of the main alarm circuit main alarm. This regulating circuit also includes means for limiting the peak value of the signal and where the signal is initially AC the circuit includes means for converting the signal to DC. A timing initiation circuit is connected with the signal regulating circuit for producing a timing initiation signal in response to the initiation signal. This timing initiation signal is applied to a third circuit, specifically a main alarm timing circuit which is connected with the timing initiation circuit for producing a main alarm deactivation and secondary alarm activation signal in response to but in an adjustably fixed period of time after the timing initiation signal. This deactivation signal is applied back to the main alarm circuit for deactivating the circuit and main alarm and is also applied to a secondary audio alarm, an alarm comprising part of the arrangement itself for activating this secondary alarm. A fourth circuit, specifically a secondary alarm timing and reset circuit, is connected with the main alarm timing circuit, with the secondary alarm and with the main alarm circuit and produces a secondary alarm deactivating an alarm circuit resetting signal in response to but in an adjustably fixed period of time after the main alarm deactivating and secondary alarm activating signal, i.e., an adjustably fixed period of time after activation of the secondary alarm. This signal is provided for automatically deactivating the secondary alarm and automatically resetting the main alarm circuit.

From the foregoing and as will become apparent hereinafter, the present invention provides a reliable and economical way to rapidly test an alarm system without requiring more than one individual. In addition, the arrangement can utilize its own secondary alarm, preferably an audio alarm, which would be located in the vicinity of the main alarm panel. An audio transmitter, for example a walkie talkie, could be placed adjacent the secondary alarm. The operator at the remote sensor site would have an audio receiver, for example a second walkie talkie. In this manner, the main alarm could be timed to deactivate a very short period of time after its activation and the secondary alarm could be made to remain activated for a much longer period of time. Hence, while the main alarm is activated for a very short period of time, the tester could readily tell whether or not the alarm circuit has activated upon activation of the remote sensor by listening for the sound of the secondary alarm. In this regard, the secondary alarm which could be placed in very close proximity to the audio transmitter could be made to produce a relatively soft sound compared to that of the main alarm. In this way, the nuisance noise of the main alarm could be substantially minimized if not practically eliminated.

DETAILED DESCRIPTION

Figure 1:
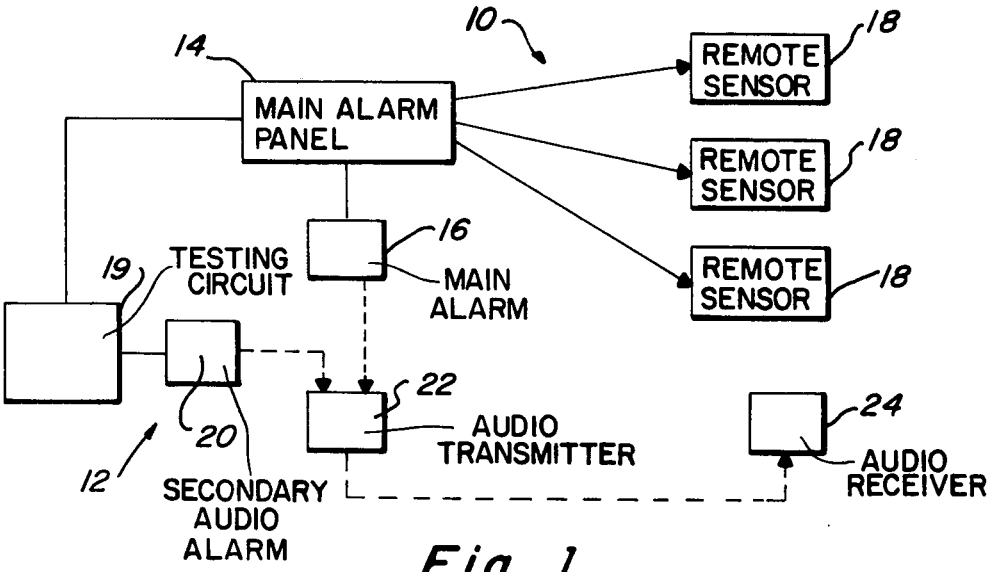
FIG. 1 is a block diagram illustrating an alarm system and an arrangement for testing the system, which arrangement is constructed in accordance with the present invention.

Turning to the drawing, attention is specifically directed to FIG. 1 which illustrates an alarm system 10 and an arrangement for testing the system, which arrangement is generally designated by the reference numeral 12. Alarm system 10 is conventional and does not per se comprise part of the present invention except of course that certain operating features of the system to be described must be compatable with arrangement 12. This alarm system includes a main alarm panel 14 which houses much if not practically all of the system's circuitry responsible for operating the system. Since the alarm circuit is conventional, it will not be discussed herein except where such a discussion is relevant to the operation of the testing arrangement 12. The alarm system also includes one or more audio alarms 16 connected with and located in the vicinity of main panel 14, i.e., the main alarm circuit and a plurality of remote sensors 18 which are also connected with the main alarm circuit. The audio alarm and remote sensors are also conventional and are connected with the main alarm circuit such that activation of at least one of the sensors activates the alarm circuit which, in turn, activates the main alarm. In other words, should one of the sensors activate in response to heat, smoke or the like in its area of coverage the signal is transmitted from the sensor to the main alarm circuit which operates to activate main alarm 16, i.e., for sounding the alarm.

In order to be compatible with the testing arrangement of the present invention, the main alarm circuit of alarm system 10 is one which has or may be made to have conventional means for deactivating the alarm, preferably for deactivating the entire circuit itself including the alarm. The circuit is also one which once activated and subsequently deactivated requires resetting and includes or may be made to include conventional means for automatically resetting the circuit once activated and subsequently deactivated. As will be seen, in a preferred embodiment of the present invention, the main alarm circuit is one which automatically resets itself after the power to the circuit has been disconnected therefrom and subsequently reconnected therewith.

In accordance with the present invention testing arrangement 12 includes a testing circuit generally designated at 19 connected with the main alarm circuit in panel 14, a secondary audio alarm device 20 connected with circuit 19, an audio transmitter 22 and an audio receiver 24, for example a pair of standard walkie talkies. As illustrated in FIG. 1, circuit 19 and alarm 20 are located adjacent the main alarm panel 14 and main alarm 16. As also illustrated in this FIGURE, the transmitter 22 is located adjacent both of the alarms 16 and 20, sufficiently close to transmit the sound from these alarms to receiver 24 which itself is located adjacent one of the remote centers, specifically the sensor being tested.

With audio transmitter positioned in the manner just described, i.e., adjacent alarms 16 and 20, alarm system 10 is tested by testing the remote sensors one at a time. The individual tester carries audio receiver 24 to one of the remote sensors and artificially activates the sensor. When the alarm system including this particular sensor is in proper working order, activation of the sensor will cause the main alarm circuit to activate, in turn activating main alarm 16. This main alarm remains activated for an adjustably fixed period of time and then is automatically deactivated. Upon deactivation of the main alarm, secondary alarm 20 automatically activates for a second adjustably fixed period of time. It then deactivates and at the same time the main alarm circuit in panel 14 is automatically reset so that the next remote sensor can be activated for testing the system with that sensor. The sound from both alarm 16 and alarm 20 during activation of these alarms is transmitted via transmitter 22 to receiver 24. Hence, while the tester may be located a relatively far distance from the main alarm panel he immediately knows that the system including the particular remote sensor being tested is in proper working order. Obviously, if the tester does not hear the alarms he is alerted to a malfunction.

As stated above, main alarm 16 is on for an adjustably fixed period of time followed by activation of alarm 20 for an adjustably fixed period of time. In a preferred embodiment, the main alarm remains on for a very short period of time, for example a single ring and alarm 20 remains on for a relatively longer period of time, up to for example 10 seconds whereupon it is deactivated and the main alarm circuit reset. In addition, the sound level of alarm 20 preferably is substantially below that of main alarm 16 but, of course, must be of a sufficient level to be readily heard by the tester via transmitter 22 and receiver 24. In this way, individuals working around the main alarm panel and main alarm are not unduly disturbed during the testing of the various remote sensors.

As also stated above, the main alarm circuit of system 10 and main alarm once activated are deactivated and the main alarm circuit is subsequently reset. This may be accomplished by any suitable means initiated by suitable signals from circuit 19 of arrangement 12. For example, circuit 19 may be suitably tied into an appropriate switch or switches in the alarm circuit. These switches could be readily provided and circuit 19 could be readily tied into them. However, in a preferred embodiment, the main alarm circuit and main alarm are deactivated by disconnecting them from their source of power and the main alarm circuit is preferably reset by reconnecting the circuit to its power supply. As will be seen hereinafter, this can be accomplished by providing circuit 19 of arrangement 12 with an appropriate switch connected in the power supply line to the main alarm circuit.

Figure 2:
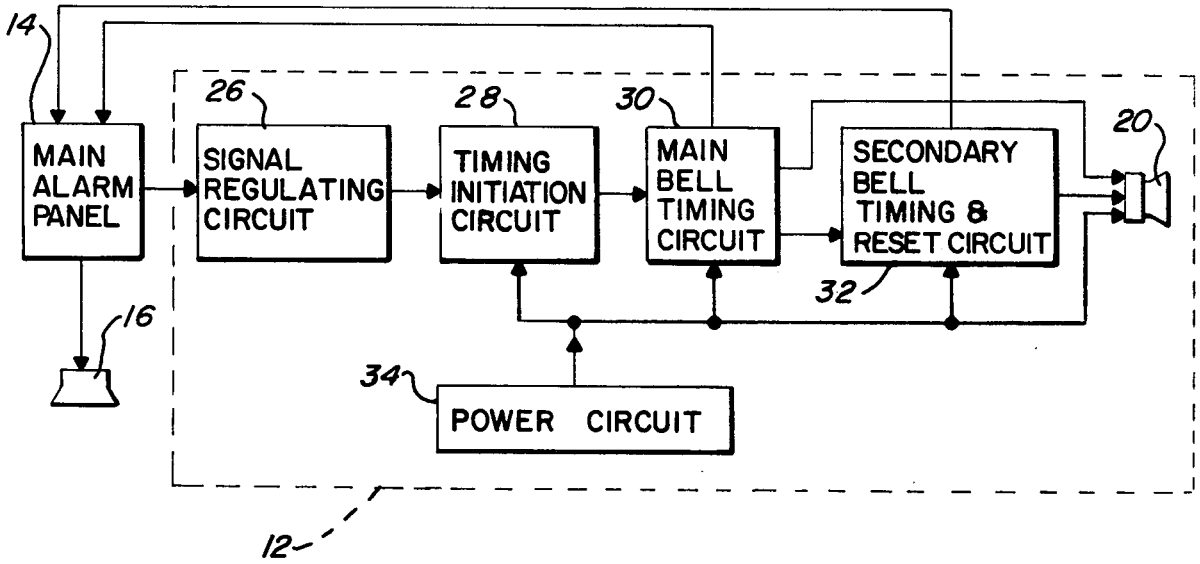
FIG. 2 is a more detailed block diagram of the arrangement illustrated in FIG. 1.

Having described arrangement 12 generally, attention is now directed to FIG. 2 which is a more detailed block diagram of the arrangement. As seen in this FIGURE, circuit 19 of arrangement 12 includes a signal regulating circuit 26 which is connected with the main alarm circuit in panel 14, a timing initiation circuit 28 connected with circuit 26, a main bell timing circuit 30 which is connected with circuit 28 and which is also connected with alarm 20 and back to the main alarm circuit, and a secondary bell timing and reset circuit 32 which is connected with circuit 30 and also with alarm 20 and the main alarm circuit in panel 14. As will be seen hereinafter, circuits 28, 30 and 32 and alarm 20 are powered by means of a power supply circuit 34.

In operation, once a remote sensor 18 is artificially activated, if it in turn activates the main alarm circuit in panel 14 and main alarm 16, a signal is applied to signal regulating circuit 26. In many cases, the alarm system operates an alternate current voltage (AC) whereas circuit 19 and alarm 20 of arrangement 12 preferably operate on direct current voltage (DC). With this being the case, signal regulating circuit 26 converts the AC signal to a DC signal and limits the peak value of this signal. The signal from circuit 26, which may be referred to as an overall circuit initiation signal, is applied to the timing initiation circuit 28. This circuit in response to the signal applied to its input produces what may be referred to as a timing initiation signal. This timing initiation signal which is produced approximately simultaneously with the activation of the main alarm circuit in panel 14 and the main alarm 16 is applied to the main bell timing circuit 30. An adjustably fixed period of time after receiving the timing initiation signal, circuit 30 produces what may be referred to as a main alarm deactivation and secondary alarm activation signal. Actually, this latter signal is comprised of three signals as will be seen in FIG. 3. However, for purposes of discussion and explanation with respect to FIG. 2 it may be thought of as a single signal. This signal is applied back to the main alarm circuit for deactivating the circuit and deactivating alarm 16. As stated previously, this is preferably accomplished by disconnecting the main alarm circuit and main alarm from its source of power. The signal from circuit 30 is also applied to alarm 20 for activating the latter and is applied to the input of secondary bell timing and reset circuit 32. In response to this signal, circuit 32 produces a signal, actually two signals, a secondary alarm deactivating signal and an alarm circuit resetting signal. These signals are produced in an adjustably fixed period of time after circuit 32 receives the signal from circuit 30 and automatically deactivates alarm 20 and resets the main alarm circuit in panel 14. As will be seen with respect to FIG. 3, resetting of the alarm circuit is preferably accomplished by reconnecting the alarm circuit to its source of power by means of the signal from circuit 32.

From the foregoing, it can be seen that main alarm 16 once activated remains activated until the main alarm deactivation and secondary alarm activation signal is produced at the output of main bell timing circuit 30. The main alarm and entire main alarm circuit are then deactivated and at the same time the alarm 20 begins to sound. Alarm 20 remains on until the secondary alarm deactivating and alarm circuit resetting signal is produced at the output of circuit 32 whereupon the alarm automatically turns off and the main alarm circuit is automatically reset.

Figure 3:
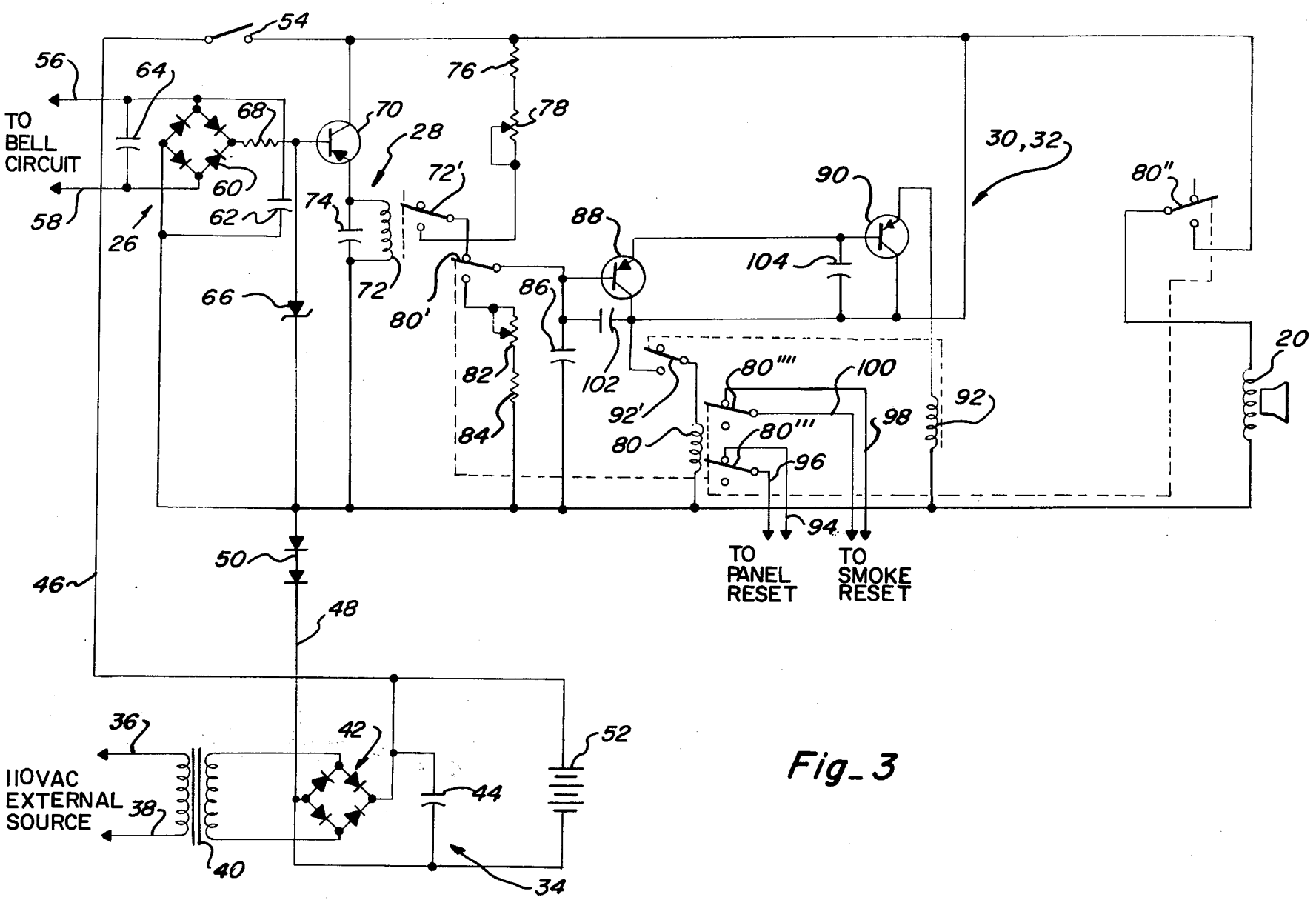
FIG. 3 is a detailed schematic illustration of the testing arrangement illustrated in FIGS. 1 and 2.

Turning to FIG. 3, attention is now directed to the preferred detailed circuitry making up the testing arrangement 12. It is to be understood that the individual components making up this circuit may in themselves be conventional and readily provided by those with ordinary skill in the art. Hence, the individual components will not be described in detail except where it is required to provide a complete understanding of the entire circuit.

As illustrated in FIG, 3, power supply circuit 34 includes a pair of leads 36 and 38 which are adapted to be connected to an external 110V AC supply, for example through a supply receptacle adjacent the main alarm panel 14. The 110 voltage is transformed down to a 12 volt level by a transformer 40 positioned across the leads 36 and 38. A 12 V DC bridge rectifier 42 and a condenser 44 are connected across the secondary of transformer 40 so as to convert the 12 volt AC across the secondary of the transformer to 12 volts DC. This 12 V DC is provided for operating previously described circuits 28, 30 and 32 and alarm 20 by positive and negative (ground) leads 46 and 48. In this regard, a pair of diodes 50 are provided in the negative line for protection against reverse voltage and current.

Power supply circuit 34 may also include a self-contained 12V DC battery indicated at 52 which is connected across the output of rectifier 42, as illustrated in FIG. 3. In this manner, circuits 28, 30 and 32 and alarm 20 may be powered alternatively by the battery where, for example, a 110V AC outlet is not conveniently located. In this regard, the battery can be of a rechargeable type and is connected so that it may be easily recharged by a 110V AC supply via leads 36 and 38.

In order to connect and disconnect the various circuits powered by circuit 34, a single pole single throw (SPST) switch or other suitable switch indicated at 54 is connected in line with positive lead 46. This switch disconnects the various circuits powered by circuit 34 from circuit 34 but still allows battery 52 to be charged during this time.

Signal regulator circuit 26 includes leads 56 and 58 which are adapted to be connected into the main alarm circuit in panel 14. These leads are connected so as to receive the same signal as main alarm 16, for example, in parallel with the leads to the main alarm. Circuit 26 also includes a bridge rectifier 60 connected across the leads 56 and 58, a pair of filter capacitors 62 and 64 and a voltage limiting zener diode circuit including zener diode 66 and resistor 68 connected across the output of the bridge rectifier.

Operationally, when the main alarm circuit activates thereby activating main alarm 16, the same signal through the main alarm is also supplied to the input of rectifier 60 via leads 56 and 58. This signal, which heretofore has been referred to as the initiation signal, is rectified from AC to DC by the rectifier and is limited in peak value by the zener diode circuit, for example to a level of 4 to 5 volts DC. This signal is now ready to be applied to the timing initiation circuit 28.

Timing initiation circuit 28 includes a transistor 70 having its base connected to the output of circuit 26, its collector connected to the positive supply line 46 and its emitter connected to an electromagnetic relay coil 72 and bypass capacitor 74 both of which comprise part of circuit 28 and both of which are connected to ground line 48. When the initiation signal from circuit 26 is applied to the base of transistor 70, this transistor is triggered from a non-conductive state to a conductive state which in turn energizes coil 72. Energization of this coil causes its normally open contact 72′ to close. The closing of this contact initiates the main bell timing circuit 30, as will be discussed below, and has heretofore been referred to as the timing initiation signal.

While both circuits 26 and 28 were discussed individually, for purposes of clarity main bell timing circuit 30 and secondary bell timing and reset circuit 32 will be discussed together, particularly in view of the fact that they share many components. The main bell timing circuit itself includes a fixed resistor 76 in series with a variable resistor 78, both of which are in series with relay contact 72′ and a relay contact 80′ of a second electromagnetic relay 80 to be discussed below. There are three leads coming from contact 80′, one connected in series with a second variable resistor 82 and fixed resistor 84, the second lead extending to a charging capacitor, 86, both of these circuits being connected to ground, and the third lead being connected to the base of a transistor 88. Transistor 88 has its emitter connected to the base of a second transistor 90 and its collector is connected through a relay contact 92′ of an electromagnetic relay 92, also to be discussed below.

Previously mentioned electromagnetic relay coil 80 is connected between contact 92′ and ground. Coil 80 not only includes contact 80′ but also three other contacts. One of these contacts, 80″ is connected in line with the energizing coil of alarm 20 and a transmitter 94, if one is used. The third contact, 80‴, is connected in one of two positions, in the position shown, it closes two leads to the main alarm circuit, specifically to the power supply line in the circuit to maintain the power to the alarm circuit connected. In its other position, the leads, generally designated at 94 and 96, are opened, thereby cutting power to the main alarm circuit and hence deactivating the circuit and main alarm. The last contact 80⁗ is connected across leads 98 and 100 which also go back to the main alarm panel and to the main alarm circuit to operate in the same manner as contact 80‴ if a second reset is required. For example, this may comprise the reset for a smoke alarm.

As stated above, the emitter of transistor 88 is connected to the base of transistor 90. This latter transistor has its emitter connected to one side of electromagnetic coil 92 the other side being connected to ground and has its collector connected to the positive lead and also to contact 92'. Both transistors 88 and 90 include bypass capacitors 102 and 104, each bypass capacitor being connected across the base and collector of its respective transistor.

Having described the various components making up the two circuits 30 and 32, i.e., the main bell timing circuit and secondary bell timing and reset circuit, attention is now directed to the manner in which the circuits operate. As stated above, the main bell timing circuit 30 is initiated into operation by the timing initiation signal at the output of the timing initiation circuit 28. This signal, as also stated, resides in the closing of contact 72' resulting from the energization of coil 72. When contact 72' closes, charging capacitor 86 is connected to supply line 46 through fixed resistor 76, variable resistor 78 and relay contact 80'. In this regard, contact 80' is in normally a closed position with respect to the circuit including these resistors and the charging capacitors, i.e., so long as relay coil 80 remains deenergized, relay contact 80' remains closed so that current can pass to the charging capacitor through the fixed resistor 76 and variable resistor 78. With the circuit in this state, the charging capacitor charges up to a predetermined level over a period of time. This period of time can be varied by varying adjustable resistor 78. As will be seen below, this period of time represents the adjustably fixed period of time that the main alarm circuit in panel 14 and the main alarm 16 remain activated.

When charging capacitor 86 reaches its predetermined charged level, it triggers transistor 88 which in turn triggers transistor 90. Transistor 90, now in its triggered or conductive state, allows current to pass through relay coil 92. With relay coil 92 energized, its contact 92' shifts from a normally open position to a closed position allowing current to pass through relay coil 80. As will be seen directly below, it is the energization of this latter coil which deactivates the main alarm circuit and main alarm 16 and at the same time activates the secondary alarm, i.e., alarm 20. In other words, it is the energization of coil 80 which is in essence responsible for the main alarm deactivation and secondary alarm activation signal referred to above.

With relay coil 80 in its energized state, relay contact 80' moves from its normally closed position in the charging line of the capacitor 86 to a second position whereby capacitor 86 is connected to adjustable resistor 82 and fixed resistor 84. Contact 80'' goes from a normally open position to a normally closed position and contacts 80''' and 80'''' move to open positions from normally closed positions. With these contacts in these positions, it should be apparent from FIG. 3 that alarm 20 is activated, i.e., connected to positive line 46 through the now closed contact 80''. It should also be apparent that leads 94 and 96 are open and leads 98 and 100 are open. As stated above, these leads connect into the main alarm circuit to deactivate the latter, preferably by cutting power to the main alarm. Accordingly, the main alarm circuit including main alarm 16 is in a deactivated state and the secondary alarm 20 is in an activated state.

With contact 80' in its second position, charged capacitor 86 begins to discharge through variable resistor 82 and 84. After a predetermined period of discharging time, which period can be varied by varied resistor 82, transistors 88 and 90 turn off. As will be seen below, this second period of time is the period during which the secondary alarm 20 remains activated and is also the period of time before which the main alarm circuit is reset.

Once the charging capacitor 86 discharges to a predetermined level in the adjustably fixed period of time, transistors 88 and 90 turn off as just stated. Once these transistors turn off, coil 92 deenergizes which, in turn, causes its contact 92' to open, thereby causing coil 80 to deenergize. Deenergization of coil 80 returns contact 80'' to its initial position thereby deactivating alarm 20 and returns contacts 80''' and 80'''' to their normally closed positions, thereby returning the main alarm circuit to its normal operating condition, i.e., its reset position. As stated previously, this can be accomplished by connecting circuit 32 into an appropriate resetting circuit in the main alarm circuit or it can be accomplished by returning power to the main alarm circuit which, as also stated, is preferable. Obviously, if the entire main alarm circuit only requires one reset, both pair of leads 94, 96 and 98, 100 would not be necessary, and only one of the pair is required. By the same token, if the main alarm circuit requires more than two resets, more than two pair of leads could be provided.

This last operation, specifically, the deenergization of coil 80 can be viewed as the production of the aforediscussed secondary alarm deactivating and alarm circuit resetting signal. As a result of the production of this signal, i.e., as a result of the deenergization of coil 80, contact 80' also moves back to its normal position in circuit with capacitor 86 and resistors 76 and 78. The entire circuit 18 is now ready for testing a second sensor.

In summarizing the operation of the testing arrangement, it can be noted that upon activating the main alarm circuit and main alarm 16, a signal is simultaneously applied to signal regulating circuit 26 which, in turn, converts this signal to DC and regulates the amplitude of the signal. This signal is applied to the initiation circuit 28, i.e., to the base transistor 70, which causes coil 72 to energize to begin the charging of capacitor 86. After a predetermined charging time, dependent upon the value of variable resistor 78, transistors 88 and 90 begin to conduct, thereby energizing coils 92 and 80. Energization of coil 80 deactivates the main alarm circuit and main alarm and at the same time activates secondary alarm 20 begins the discharging period of time of capacitor 86. After the predetermined discharge time, dependent upon the value of resistor 82, the secondary alarm is deactivated and the main alarm circuit is reset.

It is to be understood, as stated above, that the various components making up circuit 19 may be conventional and, in any event, may be readily provided by those with ordinary skill in the art in view of the present disclosure. These various components and/or subcircuits making up a number of these components may be modified or replaced with equivalent components. In addition, the particular values required for the components, for example, the resistance values, capacitance values and so on may be varied, and, in any event, could be provided by those with ordinary skill in the art in view of the present disclosure.

From the foregoing, it should be apparent that the present invention provides an uncomplicated and relatively economical way to test a standard fire alarm system of the type described above. In accordance with the present invention, testing of the alarm system requires only one individual, this individual being stationed at the remote sensors. The present invention also provides for at most minimal noise nuisance from the main audio alarm, if any nuisance at all. Hence, the present invention is particularly suitable for use in testing alarms in schools, hospitals and at large complexes where the remote sensors are located great distances from the main circuit and where large degrees of noise would not be appreciated.

What is claimed is:

1. An arrangement for testing an alarm system which includes a main alarm activation circuit and a plurality of remote sensors connected with said circuit such that activation of at least one of said sensors activates said circuit, said alarm activation circuit including means for deactivating the circuit once activated and means for resetting the circuit once activated and subsequently deactivated, said arrangement comprising:

a. first means responsive to the activation of said alarm activation circuit for producing a first signal, said signal being applied to said deactivating means of said circuit for automatically deactivating said circuit;

b. an alarm;

c. second means connected with said first means and with said alarm for activating said alarm in response to said first signal; and d. third means connected with said second means for deactivating said alarm and for producing a second signal a predetermined period of time after activation of said alarm, said second signal being applied to said resetting means of said alarm activation circuit for automatically resetting said circuit.

2. An arrangement according to claim 1 wherein said first means includes means for producing said first signal an adjustably fixed period of time after activation of said circuit, whereby said circuit is deactivated only after said fixed period of time.

3. An arrangement according to claim 1 wherein said third means includes means for adjustably fixing said predetermined period of time, whereby said alarm, once activated is deactivated only after said period of time and said circuit is reset only after said period of time.

4. An arrangement according to claim 1 wherein said alarm is located in proximity to said alarm activation circuit, said arrangement including means for transmitting a signal indicating activation of said alarm to a point in close proximity to one of said sensors.

5. An arrangement according to claim 1 wherein said alarm is an audio alarm.

6. An arrangement for testing an alarm system which includes an alarm activation circuit, a main audio alarm and a plurality of remote sensors, all of which are connected together such that activation of at least one of said sensors activates said circuit which in turn activates said main alarm, said circuit including means for deactivating the circuit and audio alarm once activated and means for resetting the circuit once activated and subsequently deactivated, said arrangement comprising:

a. first means responsive to the activation of said alarm activation circuit and said main alarm for producing a first signal an adjustably fixed period of time after activation of said circuit and alarm, said signal being applied to said deactivating means of said circuit for deactivating said circuit and alarm, whereby said alarm is deactivated only after said period of time;

b. a secondary audio alarm;

c. a second means connected with said first means and with said secondary alarm for activating said secondary alarm in response to said first signal; and d. third means connected with said second means for deactivating said secondary alarm and for producing a second signal an adjustably fixed period of time after activation of said secondary alarm, said second signal being applied to said resetting means of said alarm activation circuit for automatically resetting said circuit, whereby said secondary alarm, once activated, is deactivated only after said last-mentioned period of time and said circuit is reset only after said last-mentioned period of time.

7. An arrangement according to claim 6 wherein said main alarm and secondary alarm are located adjacent one another, remote from said sensors, said arrangement including an audio transmitter located adjacent said alarms and an audio receiver located adjacent one of said sensors, whereby the sound from said alarms, when the latter are activated, is transmitted by said transmitter to said receiver.

8. An arrangement for testing an AC powered alarm system which includes a main alarm activation circuit, a main audio alarm and a plurality of remote sensors, all of which are connected together such that activation of at least one of said sensors activates said circuit which in turn activates said main alarm, said circuit including means for deactivating the circuit and main alarm once activated and means for resetting the circuit once activated and subsequently deactivated, said arrangement comprising:

a. first signal regulating circuit means connected with said alarm circuit for producing an initiation signal in response to the activation of said alarm circuit and said alarm, said first circuit means including means limiting the peak value of said signal;

b. second timing initiation circuit means connected with said first circuit means for producing a timing initiation signal in response to said initiation signal;

c. third main alarm timing circuit means connected with said second circuit means and the deactivating means of said alarm circuit for producing a main alarm deactivation and secondary alarm activation signal in response to but an adjustably fixed period of time after said timing initiation signal, said deactivation signal automatically deactivating said alarm circuit and main alarm;

d. a secondary audio alarm connected with said third circuit means and activating in response to said main alarm deactivation and secondary alarm activation signal;

e. fourth circuit means connected with said third means, said secondary alarm and the resetting means of said alarm circuit for producing a secondary alarm deactivating and alarm circuit resetting signal in response to but an adjustably fixed period of time after said last-mentioned signal, said secondary alarm deactivating and alarm circuit resetting signal automatically deactivating said secondary alarm and automatically resetting said alarm circuit; and f. means for powering said second, third and fourth circuit means.

9. An arrangement according to claim 8 wherein said third main alarm timing circuit means includes a capacitor charging circuit including an adjustable resistor, a charging capacitor and means responsive to said initiation signal for connecting said power means with said charging circuit and said capacitor in response to said timing initiation signal, said capacitor charging to a predetermined level after said first-mentioned predetermined period of time and upon reaching said level producing said main alarm deactivation and secondary alarm activation signal.

10. An arrangement according to claim 9 wherein said fourth circuit means includes said charging capacitor, a capacitor discharging circuit including an adjustable resistor and means responsive to said main alarm deactivation and secondary alarm activation signal for connecting said capacitor with said discharging circuit, said capacitor discharging to a predetermined level after said second-mentioned period of time and upon reaching said discharge level producing said secondary alarm deactivating and alarm circuit resetting signal.

11. An arrangement according to claim 8 wherein third circuit means includes means for disconnecting the power to said main alarm circuit and main alarm in response to said main alarm deactivation and secondary alarm signal, whereby to deactivate said alarm circuit and main alarm.

12. An arrangement according to claim 11 wherein said alarm circuit automatically resets after the power to said circuit has been disconnected and subsequently reconnected, said fourth circuit means including means for reconnecting said power to said alarm circuit in response to said secondary alarm deactivating and alarm circuit resetting signal whereby said alarm circuit automatically resets.

13. A method of testing an alarm system which includes an alarm activation circuit and a plurality of remote sensors connected with said circuit such that activation of at least one of said sensors activates said circuit, said circuit once activated and subsequently deactivated requiring resetting before further use, said method comprising:

a. activating a preselected one of said sensors at the location of said preselected sensor;
b. from said location, sensing whether said circuit has been activated in response to the activation of said preselected sensor;
c. automatically deactivating said circuit in the event said circuit has been activated; and
d. automatically resetting said circuit after activation and subsequent deactivation thereof without the aid of an operator.

14. A method according to claim 13 wherein said circuit once activated is deactivated an adjustably fixed period of time after activation thereof.

15. A method according to claim 14 wherein said circuit once deactivated is automatically reset an adjustably fixed period of time after deactivation thereof.

16. A method according to claim 15 including automatically:

a. activating an audio alarm located adjacent said circuit upon deactivation of said circuit,
b. transmitting the sound from said alarm to the location of said preselected sensor, and
c. thereafter deactivating said alarm.

17. A method according to claim 16 wherein said alarm is deactivated at the same time said circuit is reset.

18. A method according to claim 17 wherein said alarm system includes a main audio alarm located adjacent said circuit, which alarm activates upon activation of said circuit, said method including deactivating said main alarm at the same time said circuit is deactivated.

19. A method according to claim 13 wherein said circuit once losing power automatically resets once power is returned, said step of deactivating said circuit comprising disconnecting said circuit from its supply of power and said step of resetting said circuit comprising reconnecting said circuit to its supply of power.

* * * * *